US011740047B2

(12) United States Patent
Lee et al.

(10) Patent No.: US 11,740,047 B2
(45) Date of Patent: Aug. 29, 2023

(54) FIREARM MUZZLE ATTACHMENT MECHANISM

(71) Applicants: Shanyao Lee, Santa Ana, CA (US); Chien-Yuan Cheng, Santa Ana, CA (US)

(72) Inventors: Shanyao Lee, Santa Ana, CA (US); Chien-Yuan Cheng, Santa Ana, CA (US)

( * ) Notice: Subject to any disclaimer, the term of this patent is extended or adjusted under 35 U.S.C. 154(b) by 0 days.

(21) Appl. No.: 17/508,147

(22) Filed: Oct. 22, 2021

(65) Prior Publication Data

US 2023/0128649 A1 Apr. 27, 2023

(51) Int. Cl.
*F41A 21/32* (2006.01)

(52) U.S. Cl.
CPC ..... *F41A 21/325* (2013.01)

(58) Field of Classification Search
CPC ..... F41A 21/32; F41A 21/325
See application file for complete search history.

(56) References Cited

U.S. PATENT DOCUMENTS 4,510,843 A * 4/1985 Rabatin ..... F41A 21/325 89/14.4
6,385,891 B1 * 5/2002 Rabatin ..... F41A 21/325 42/79
6,973,863 B1 * 12/2005 Jones ..... F41A 21/32 89/14.2
8,997,621 B1 * 4/2015 Dater ..... F41A 21/325 89/14.3
9,182,187 B1 * 11/2015 Griffith ..... F41A 21/325
2005/0115394 A1 * 6/2005 Matthews ..... F41A 21/325 89/14.4
2010/0229712 A1 * 9/2010 Graham ..... F41A 21/34 42/76.01
2010/0281747 A1 * 11/2010 Anderson ..... F41A 21/26 42/90
2015/0253098 A1 * 9/2015 Russell ..... F41A 21/30 89/14.4
2018/0292164 A1 * 10/2018 Thompson ..... F41A 21/36
2019/0310045 A1 * 10/2019 Odle ..... F41A 21/34
2021/0356225 A1 * 11/2021 Kras ..... F41A 21/325

* cited by examiner

*Primary Examiner* — Bret Hayes
(74) *Attorney, Agent, or Firm* — Che-Yang Chen; Law Office of Michael Chen

(57) ABSTRACT

A firearm muzzle attachment mechanism includes a muzzle device; a tapering adapter having an outer tapering end configured to connect with the muzzle device; a hollow adapter having an internally threaded portion and configured to receive the muzzle device; a muzzle attachment having an inner tapering end configured to connect with the outer tapering end of the tapering adapter; and a means for providing tension being received in a receiving slot formed on the muzzle attachment.

39 Claims, 6 Drawing Sheets

100

30

10

FIREARM MUZZLE ATTACHMENT MECHANISM

FIELD OF THE DISCLOSURE

The present disclosure relates to a firearm muzzle attachment mechanism, and more particularly, the firearm muzzle attachment mechanism comprises an improved structure to prevent each part of the disclosure mechanism being loosened during the shooting.

BACKGROUND OF THE DISCLOSURE

Generally, a silencer is one kind of muzzle attachment devices for silencing the firearm during the shootings. According to the previously published UK patent of patent number GB2242476 with the applicant of Gregory Saul Felton, the clamp unit adapted to manually clamp the silencer on the military or sporting weapon includes an elongated member, a hollow adaptor unit for inter-engagement with the elongated member, and a locking body adapted to cooperate with the hollow adapter unit.

However, the above-mentioned published UK patent has several drawbacks. While the bullets are shooting through the elongated member, the hollow adaptor unit, and the locking body, the elongated member may not securely engage with the locking body. For example, during the shooting process, the bullets may pass through the elongated member, the hollow adaptor unit, and the locking unit with an extremely high speed, and in such a way, the heat and the vibration generated from the bullets may cause the hollow adaptor unit loosing from the elongated member or the locking body. Therefore, it may be dangerous for the shooter to operate the firearm.

Therefore, there may be needed a way to provide the silencer and muzzle attachment devices to be securely mounted on the firearm without breaking into several pieces during shootings.

All referenced patents, applications and literatures are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The disclosed embodiments may seek to satisfy one or more of the above-mentioned desires. Although the present embodiments may obviate one or more of the above-mentioned desires, it should be understood that some aspects of the embodiments might not necessarily obviate them.

BRIEF SUMMARY OF THE DISCLOSURE

In a general implementation, the firearm muzzle attachment mechanism comprises a muzzle device; a tapering adapter having an outer tapering end configured to connect with the muzzle device; a hollow adapter having an internally threaded portion and configured to receive the muzzle device; a muzzle attachment having an inner tapering end configured to connect with the outer tapering end of the tapering adapter; and a means for providing tension being received in a receiving slot formed on the muzzle attachment.

In another aspect combinable with the general implementation, the outer tapering end of the tapering adapter comprises a threaded end and an inclined portion integrally and outwardly thickened from the threaded end and the tapering adapter is threadedly received on a gun barrel end.

In another aspect combinable with the general implementation, the muzzle attachment further comprises a middle-threaded portion configured to threadedly receive within the hollow adapter.

In another aspect combinable with the general implementation, the inclined portion of the tapering adapter is in contact with the inner tapering end of the muzzle attachment.

In another aspect combinable with the general implementation, the muzzle attachment further comprises a flanged tapering wall where the inner tapering end is formed thereinside.

In another aspect combinable with the general implementation, the muzzle attachment further comprises a middle-threaded portion and a flanged tapering wall integrally extended from the middle threaded portion.

In another aspect combinable with the general implementation, the muzzle device comprises an internally threaded surface to threadedly engage with a gun barrel end of a firearm.

In another aspect combinable with the general implementation, the hollow adapter comprises a plurality of teeth arranged adjacent to the internally threaded portion.

In another aspect combinable with the general implementation, the muzzle attachment comprises a cylindrical tube portion integrally and outwardly thickened from a flanged taper wall of the muzzle attachment, wherein the receiving slot is formed between the cylindrical tube portion and the flanged taper wall.

In another aspect combinable with the general implementation, the muzzle attachment comprises a middle portion defined between a cylindrical tube portion and a flanged taper wall and the receiving slot is formed on the middle portion.

In another aspect combinable with the general implementation, the means for providing tension comprises a wire spring having a ring portion encircling the muzzle attachment.

In another aspect combinable with the general implementation, the means for providing tension comprises a leg transversely extended from a ring portion, wherein the leg is received within the receiving slot of the muzzle attachment.

In another aspect combinable with the general implementation, the receiving slot is transversally formed on a middle portion of the muzzle attachment.

In another aspect combinable with the general implementation, the muzzle attachment further comprises a flanged taper wall having a reduced diameter which is smaller than a diameter of a cylindrical tube portion of the muzzle attachment.

In another aspect combinable with the general implementation, the muzzle attachment further comprises an opening defining an opening edge, wherein the inner tapering end is formed along the opening edge.

In another aspect combinable with the general implementation, a leg of the means for providing tension is received inside a groove formed on a plurality of teeth located inside the hollow adapter.

In another aspect combinable with the general implementation, the outer tapering end comprises a threaded end sufficient to be received within the muzzle attachment.

In another aspect combinable with the general implementation, the middle portion is outwardly thickened from a middle-threaded portion and is sufficient to be received inside the hollow adapter.

In another aspect combinable with the general implementation, the muzzle device is sufficient to be received inside the flanged taper wall of the muzzle attachment.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above and below as acting in certain combinations and even initially claimed as such, one or more features from a claimed combination can in some cases be excised from the combination, and the claimed combination may be directed to a subcombination or variation of a subcombination.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

DETAILED DESCRIPTION OF THE EMBODIMENTS

The different aspects of the various embodiments can now be better understood by turning to the following detailed description of the embodiments, which are presented as illustrated examples of the embodiments defined in the claims. It is expressly understood that the embodiments as defined by the claims may be broader than the illustrated embodiments described below.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

It shall be understood that the term "means," as used herein, shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

Unless defined otherwise, all technical and position terms used herein have the same meaning as commonly understood by one of ordinary skill in the art to which the invention pertains. Although many methods and materials similar, modified, or equivalent to those described herein can be used in the practice of the present invention without undue experimentation, the preferred materials and methods are described herein. In describing and claiming the present invention, the following terminology will be used in accordance with the definitions set out below.

Figure 1:
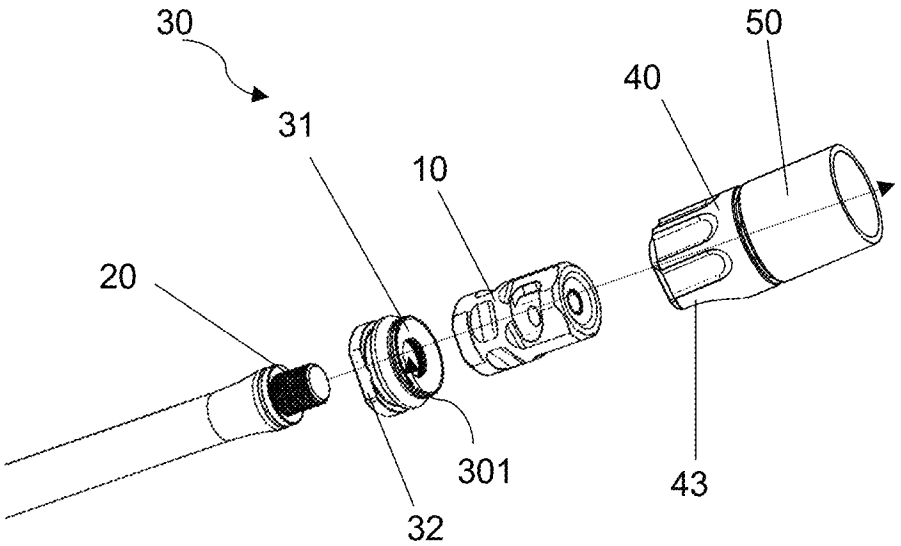
FIG. 1 is an exploded view of a firearm muzzle attachment mechanism according to an aspect of the embodiment.

FIG. 1 generally depicts a firearm muzzle attachment mechanism 100 according to an aspect of the embodiment.

Referring to FIG. 1, the firearm muzzle attachment mechanism 100 comprises a muzzle device 10 threadedly engaged with a gun barrel end 20 of a firearm, a tapering adapter 30 having an outer tapering end 31 configured to connect with the muzzle device 10 and an opposite end 32 in contact with the gun barrel end 20. The tapering end 31 may be opposite of the opposite end 32. It should be noted that the tapering adapter 30 may be a collar having an internally threaded through hole 301 having a diameter sufficient to receive the gun barrel end 20 of the firearm.

In some embodiments, the gun barrel end 20 of the firearm may be threadedly engaged with the internally threaded through hole 301 to secure the tapering adapter 30 on the firearm.

In some embodiments, the firearm muzzle attachment mechanism 100 further comprises a hollow adapter 40 connected with the tapering adapter 30 and a muzzle attachment 50 connected with the hollow adapter 40. As shown in further details of FIG. 1, the gun barrel end 20 of the firearm, the tapering adapter 30, the hollow adapter 40, the muzzle attachment 50, and the muzzle device 10 may be in alignment with each other.

Figure 2:
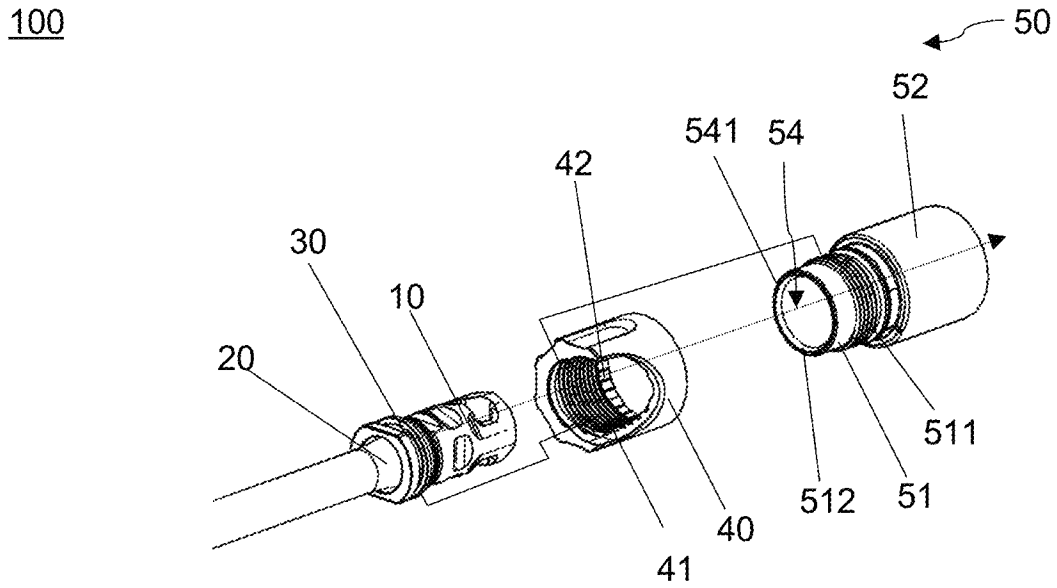
FIG. 2 is another exploded view of a firearm muzzle attachment mechanism according to an aspect of the embodiment.

FIG. 2 generally depicts the firearm muzzle attachment mechanism 100 according to an aspect of the embodiment Referring to FIG. 2, the muzzle attachment 50 comprises a flanged taper wall 51 configured to connect with the hollow adapter 40. For one example, the hollow adapter 40 comprises an internally threaded portion 41 configured to receive the flanged taper wall 51. In some embodiments, the hollow adapter 40 may be a hollow tube with the internally threaded portion 41 formed inside the hollow adapter 40.

In some embodiments, the muzzle attachment 50 further comprises a middle threaded portion 511 threadedly engaged with the internally threaded portion 41 formed inside the hollow adapter 40. The muzzle attachment 50 may further comprise a cylindrical tube portion 52 outwardly extended from the flanged taper wall 51, wherein the flanged taper wall 51 of the muzzle attachment 50 may have a reduced diameter which is smaller than a diameter of the cylindrical tube portion 52. In other words, the flanged taper wall 51 of the muzzle attachment 50 may be received inside the hollow adapter 40, and the cylindrical tube portion 52 may not be received inside the hollow adapter 40.

In some embodiments, the cylindrical tube portion 52 may be outwardly thickened from the flanged taper wall 51. In other words, the flanged taper wall 51 may be inwardly tapered from the cylindrical tube portion 52.

In some embodiments, the muzzle attachment 50 further comprises an opening 54 formed on the flanged taper wall 51, wherein the opening 54 defines an opening edge 541. The opening edge 541 is formed along a periphery of the opening 54.

In some embodiments, the muzzle attachment 50 further comprises an inner tapering end 512 arranged inside the flanged taper wall 51, wherein the inner tapering end 512 may be arranged along the opening edge 541 of the flanged taper wall 51.

In some embodiments, the hollow adapter 40 comprises a plurality of teeth 42 arranged adjacent to the internally threaded portion 41, wherein the plurality of teeth 42 may surround one side of the internally threaded portion 41. For example, the plurality of teeth 42 may be formed on only one side of the internally threaded portion 41. In other words, the plurality of teeth 42 may be formed adjacent to the flanged taper wall 51 of the muzzle attachment 50. For another example, the plurality of teeth 42 may surround an interior surface of the hollow adapter 40. For another example, the plurality of teeth 42 may be formed along an opening end of the hollow adapter 40.

In some embodiments, a length of the muzzle device 10 may be shorter than the total length of hollow adapter 40 and the muzzle attachment 50. Therefore, while the muzzle device 10 cooperates with the hollow adapter 40 and the muzzle attachment 50, the muzzle device 10 may be completely received within the hollow adapter 40 and the muzzle attachment 50.

Figure 3:
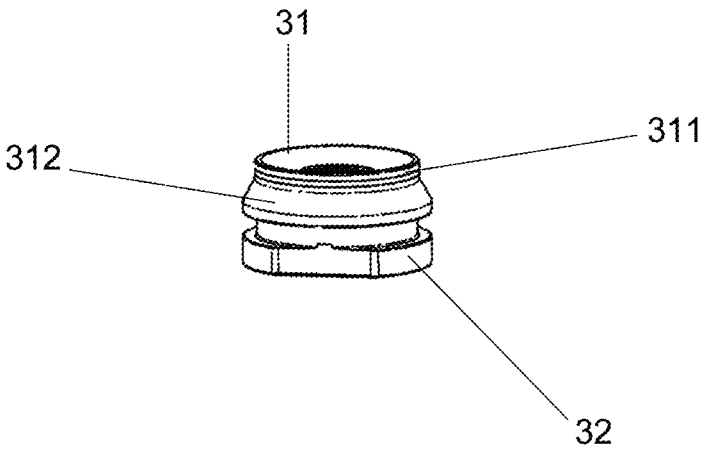
FIG. 3 is a perspective view of a tapering adapter of the firearm muzzle attachment mechanism according to an aspect of the embodiment.

FIG. 3 generally depicts the tapering adapter 30 according to an aspect of the embodiment.

Referring to FIGS. 2-3, the outer tapering end 31 of the tapering adapter 30 may comprise an inclined portion 312 integrally extended from a threaded end 311 of the outer tapering end 31, wherein the inclined portion 312 may be thickened outwardly from the threaded end 311 of the tapering end 31.

In some embodiments, the threaded end 311 of the outer tapering end 31 may be threadedly engaged with the internally threaded portion 41 of the hollow adapter 40 and the tapering adapter 30 may be threadedly received on the gun barrel end 20 of the firearm. For example, the gun barrel end 20 of the firearm may be passed through the tapering adapter 30 and threadedly engaged with the tapering adapter 30.

It should be noted that the outer tapering end 31 of the tapering adapter 30 with the threaded end 311 may have a diameter sufficient to be received within the hollow adapter 40, and in such a manner, the threaded end 311 of the tapering adapter 30 may be threadedly engaged with the internally threaded portion 41 of the hollow adapter 40.

Figure 4:
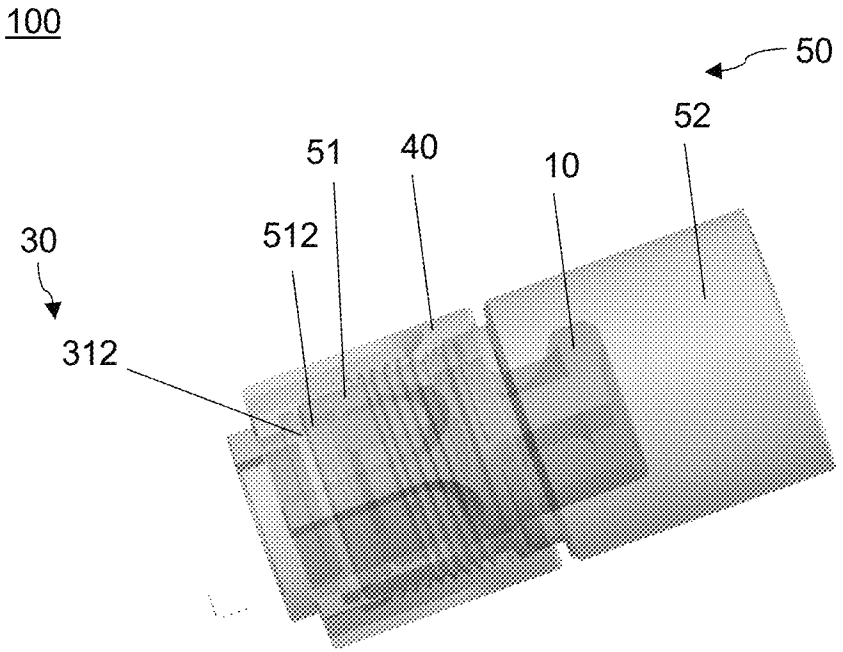
FIG. 4 is a perspective view of a firearm muzzle attachment mechanism according to an aspect of the embodiment.

FIG. 4 generally depicts the firearm muzzle attachment mechanism 100 according to an aspect of the embodiment.

Referring to FIG. 4, the inclined portion 312 of the tapering adapter 30 may be in contact with the inner tapering end 512 of the muzzle attachment 50. In some embodiments, the threaded end 311 of the tapering adapter 30 may be received inside the flanged taper wall 51 of the muzzle attachment 50, wherein the flanged taper wall 51 may cover on at least a partial inclined portion 312. For example, the inclined portion 312 of the tapering adapter 30 may be directly engaged with the inner tapering end 512 of the muzzle attachment 50 to prevent the movements therebetween during the shooting. It should be noted that the engagement between the inclined portion 312 of the tapering adapter 30 and the inner tapering end 512 of the muzzle attachment 50 may support the tapering adapter 30, the muzzle attachment 50, the hollow adapter 40, and the muzzle device 10 being in alignment with each other, and in such a manner, during the shooting, the bullets may not hit the muzzle attachment 50.

Figure 5:
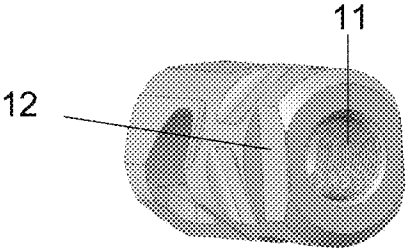
FIG. 5 is a perspective view of a muzzle device of the firearm muzzle attachment mechanism according to an aspect of the embodiment.

FIG. 5 generally depicts the muzzle device 10 according to an aspect of the embodiment.

Referring to FIGS. 2 and 5, the muzzle device 10 comprises an internally threaded surface 11 configured to threadedly receive on the gun barrel end 20 to secure the muzzle device 10 with the firearm. In some embodiments, the muzzle device 10 may be received in the hollow adapter 40, wherein the internally threaded portion 41 of the hollow adapter 40 may be threadedly engaged with the threaded end 311 of the outer tapering end 31 of the tapering adapter 30 to secure the hollow adapter 40 with the tapering adapter 30.

In some embodiments, the muzzle device 10 may further comprise an irregular outer surface which is opposite of the internally threaded surface 11. It should be noted that the gun barrel end 20 of the firearm may be threadedly engaged with the internally threaded surface 11 of the muzzle device 10 to secure the muzzle device 10 on the firearm.

Figure 6:
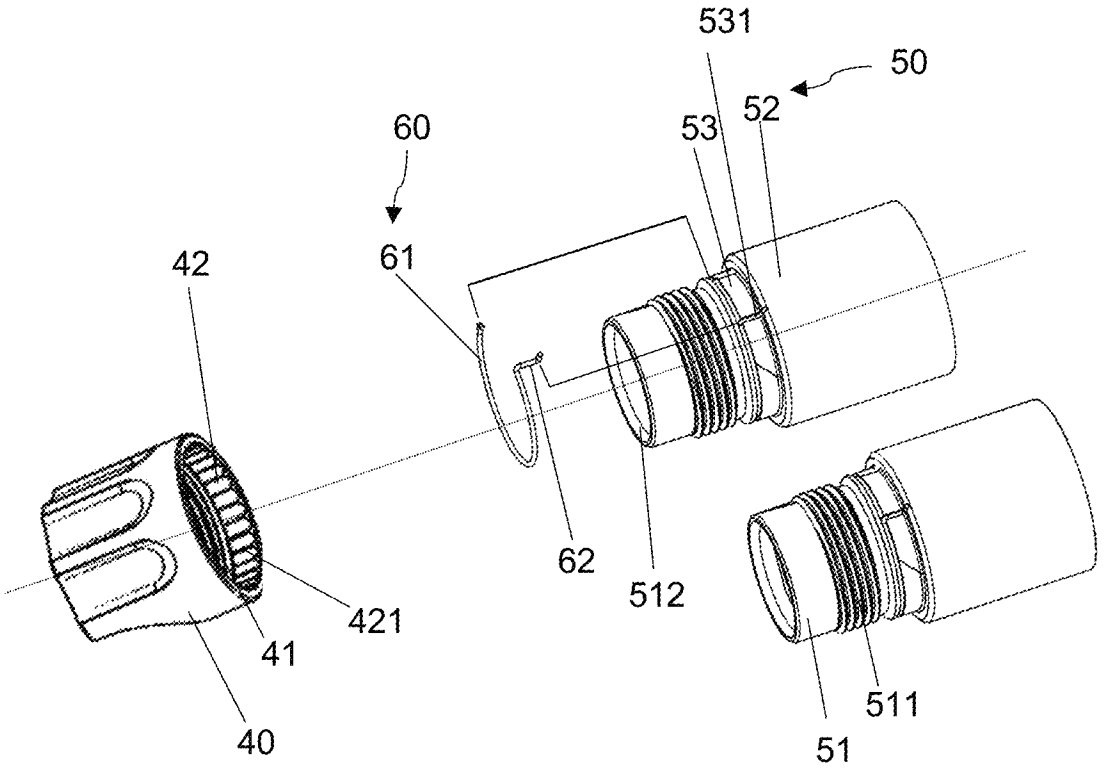
FIG. 6 is a muzzle attachment cooperated with a hollow adapter according to an aspect of the embodiment.

FIG. 6 generally depicts a wire spring 60 cooperated with the hollow adapter 40 and the muzzle attachment 50 to provide tensions therebetween according to an aspect of the embodiment.

Referring to FIG. 6, the firearm muzzle attachment mechanism further comprises the wire spring 60 configured to engage with the muzzle attachment 50 to provide tensions between the muzzle attachment 50 and the hollow adapter 40.

In some embodiments, the muzzle attachment 50 may comprise the cylindrical tube portion 52 integrally extended from the flanged taper wall 51, wherein the cylindrical tube portion 52 may be outwardly thickened from the flanged taper wall 51. In other words, the muzzle attachment 50 may be a hollow tube.

Continuing to FIG. 6, the flanged taper wall 51 may be tapered inwardly and extended from the cylindrical tube portion 52, wherein the flanged taper wall 51 may be sufficient to be received inside the hollow adapter 40.

In some embodiments, the muzzle attachment 50 may further comprise a middle portion 53 formed between the cylindrical tube portion 52 and the flanged taper wall 51, wherein the middle portion 53 may be tapered inwardly and extended from the cylindrical tube portion 52. It should be noted that the middle portion 53 of the muzzle attachment 50 may be sufficient to be received inside the hollow adapter 40. For example, the middle portion 53 and the flanged taper wall 51 of the muzzle attachment 50 may be sufficiently received inside the hollow adapter 40.

In some embodiments, the middle portion 53 may further comprise a receiving slot 531 transversally formed on the middle portion 53, and in other words, the receiving slot 531 may be formed between the cylindrical tube portion 52 and the flanged taper wall 51. For one example, the receiving slot 531 may be normal to the cylindrical tube portion 52 of the muzzle attachment 50. For another example, the receiving slot 531 may be normal to the middle-threaded portion 511 of the muzzle attachment 50.

It should be understood that the above-described locations of the receiving slot 531 are exemplary and any other locations of the receiving slot 531 can be adopted in various embodiments of this disclosure.

With specific reference to FIG. 6, the wire spring 60 may be a tension ring having an opening, wherein the wire spring 60 may have a diameter which is sufficient to encircle the middle portion 53 or/and the flanged taper wall 51 of the muzzle attachment 50.

In some embodiments, the wire spring 60 may comprise a leg 62 transversally extended from a ring portion 61 of the wire spring 60, wherein the ring portion 61 may encircle the middle portion 53 or/and the flanged taper wall 51 of the muzzle attachment 50. The leg 62 may be formed at an open end of the opening of the wire spring 60 and may be normal to the ring portion 61.

In some embodiments, the wire spring 60 may be located inside the receiving slot 531, wherein the leg 62 of the wire spring 60 may be received inside the receiving slot 531. It should be noted that a width of the leg 62 of the wire spring 60 may be at least equal to or smaller than a width of the receiving slot 531. It should be noted that a length of the leg 62 of the wire spring 60 may be at least equal to or longer than a length of the receiving slot 531.

In some embodiments, the plurality of teeth 42 may comprise a plurality of grooves 421, wherein a width of the groove 421 formed on the plurality of teeth 42 located on the hollow adapter 40 may be equal to the width of the leg 62 of the wire spring 60. In such a manner, the leg 62 of the wire spring 60 may be received inside the groove 421 to provide the tension between the hollow adapter 40 and the muzzle attachment 50.

In some embodiments, the middle threaded portion 511 of the muzzle attachment 50 may be located between the flanged tapered wall 51 and the cylindrical tube portion 52.

In this way, while the muzzle attachment 50 is cooperated with the hollow adapter 40, the middle portion 53 and the flanged tapered wall 51 may be received inside the hollow adapter 40, as shown in FIG. 4.

It should be understood that the above-described wire spring 60 is exemplary and any other structure of the wire spring 60 can be adopted in various embodiments of this disclosure.

It is important to appreciate that the present embodiment is particularly well suit for use with the gun barrel end to silence the firearm.

The contemplated wire spring 60 can be made of suitable materials to provide the tensions between the muzzle attachment 50 and the hollow adapter 40, such materials include natural and synthetic polymers, bendable metals, sol-gel materials, and all reasonable combinations thereof.

In some embodiments, the tension provided between the muzzle attachment 50 and the hollow adapter 40 could prevent the muzzle attachment 50 from being loosing from the hollow adapter 40 while the bullets are passing through the firearm muzzle attachment mechanism 100 of the present disclosure. In addition, the leg 62 of the wire spring 60 received inside the receiving slot 531 of the muzzle attachment 50 and the groove 421 of the teeth 42 may support the wire spring 60 being retaining on the muzzle attachment 50 without falling during the shooting.

Many alterations and modifications may be made by those having ordinary skill in the art without departing from the spirit and scope of the disclosed embodiments. Therefore, it must be understood that the illustrated embodiments have been set forth only for the purposes of example and that it should not be taken as limiting the embodiments as defined by the following claims. For example, notwithstanding the fact that the elements of a claim are set forth below in a certain combination, it must be expressly understood that the embodiment includes other combinations of fewer, more, or different elements, which are disclosed herein even when not initially claimed in such combinations.

Thus, specific embodiments and applications of the firearm muzzle attachment mechanism have been disclosed. It should be apparent, however, to those skilled in the art that many more modifications besides those already described are possible without departing from the disclosed concepts herein. The disclosed embodiments, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the embodiments. In addition, where the specification and claims refer to at least one of something selected from the group consisting of A, B, C . . . and N, the text should be interpreted as requiring at least one element from the group which includes N, not A plus N, or B plus N, etc.

The words used in this specification to describe the various embodiments are to be understood not only in the sense of their commonly defined meanings, but to include by special definition in this specification structure, material or acts beyond the scope of the commonly defined meanings. Thus, if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

What is claimed is:

1. A firearm muzzle attachment mechanism, comprising:
a muzzle device;
a tapering adapter having an outer tapering end configured to contact the muzzle device;
a hollow adapter having an internally threaded portion and configured to receive the muzzle device;
a means for providing tension between the hollow adapter and the muzzle attachment; and
a muzzle attachment having an inner tapering end configured to be in contact with the outer tapering end of the tapering adapter.

2. The firearm muzzle attachment mechanism of claim 1, wherein the outer tapering end of the tapering adapter comprises a threaded end and an inclined portion integrally and outwardly thickened from the threaded end and a gun barrel end of a firearm is threadedly engaged with the tapering adapter.

3. The firearm muzzle attachment mechanism of claim 2, wherein the inclined portion of the tapering adapter is in contact with the inner tapering end of the muzzle attachment.

4. The firearm muzzle attachment mechanism of claim 1, wherein the muzzle attachment further comprises a middle-threaded portion configured to threadedly receive within the hollow adapter.

5. The firearm muzzle attachment mechanism of claim 1, wherein the muzzle attachment further comprises a flanged tapering wall where the inner tapering end is formed thereinside.

6. The firearm muzzle attachment mechanism of claim 5, wherein the muzzle device can be received inside the flanged taper wall of the muzzle attachment.

7. The firearm muzzle attachment mechanism of claim 1, wherein the muzzle attachment further comprises a middle-threaded portion and a flanged tapering wall integrally extended from the middle-threaded portion.

8. The firearm muzzle attachment mechanism of claim 1, wherein the muzzle device comprises an internally threaded surface to threadedly engage with a gun barrel end of a firearm.

9. The firearm muzzle attachment mechanism of claim 1, wherein the hollow adapter comprises a plurality of teeth arranged adjacent to the internally threaded portion.

10. The firearm muzzle attachment mechanism of claim 1, wherein the muzzle attachment comprises a cylindrical tube portion integrally and outwardly thickened from a flanged taper wall of the muzzle attachment, wherein a receiving slot is formed between the cylindrical tube portion and the flanged taper wall.

11. The firearm muzzle attachment mechanism of claim 1, wherein the muzzle attachment comprises a middle portion defined between a cylindrical tube portion and a middle-threaded portion.

12. The firearm muzzle attachment mechanism of claim 11, wherein the middle portion is outwardly thickened from a middle-threaded portion of the muzzle attachment and is sufficient to be received inside the hollow adapter.

13. The firearm muzzle attachment mechanism of claim 1, wherein the means for providing tension comprises a wire spring having a ring portion encircling the muzzle attachment.

14. The firearm muzzle attachment mechanism of claim 1, wherein the means for providing tension comprises a leg transversely extended from a ring portion, wherein the leg is received within the receiving slot of the muzzle attachment.

15. The firearm muzzle attachment mechanism of claim 1, wherein the receiving slot is transversally formed on a middle portion of the muzzle attachment.

16. The firearm muzzle attachment mechanism of claim 1, wherein the muzzle attachment further comprises a flanged taper wall having a reduced diameter which is smaller than a diameter of a cylindrical tube portion of the muzzle attachment.

17. The firearm muzzle attachment mechanism of claim 1, wherein the muzzle attachment further comprises an opening defining an opening edge, wherein the inner tapering end is formed along the opening edge.

18. The firearm muzzle attachment mechanism of claim 1, wherein a leg of the means for providing tension is received inside a groove formed on a plurality of teeth located inside the hollow adapter.

19. The firearm muzzle attachment mechanism of claim 1, wherein the outer tapering end comprises a threaded end sufficient to be received within the muzzle attachment.

20. A firearm muzzle attachment mechanism, comprising:
a muzzle device;
a hollow adapter having an internally threaded portion and configured to receive the muzzle device;
a muzzle attachment; and
a means for providing tension between the hollow adapter and the muzzle attachment.

21. The firearm muzzle attachment mechanism of claim 20, further comprising a tapering adapter having an outer tapering end configured to contact the muzzle device.

22. The firearm muzzle attachment mechanism of claim 21, wherein the muzzle attachment has an inner tapering end configured to be in contact with the outer tapering end of the tapering adapter.

23. The firearm muzzle attachment mechanism of claim 22, wherein the outer tapering end of the tapering adapter comprises a threaded end and an inclined portion integrally and outwardly thickened from the threaded end and a gun barrel end of a firearm is threadedly engaged with the tapering adapter.

24. The firearm muzzle attachment mechanism of claim 20, wherein the muzzle attachment further comprises a middle-threaded portion configured to threadedly receive within the hollow adapter.

25. The firearm muzzle attachment mechanism of claim 23, wherein the inclined portion of the tapering adapter is in contact with the inner tapering end of the muzzle attachment.

26. The firearm muzzle attachment mechanism of claim 20, wherein the muzzle attachment further comprises a flanged tapering wall where the inner tapering end is formed thereinside.

27. The firearm muzzle attachment mechanism of claim 20, wherein the muzzle attachment further comprises a middle-threaded portion and a flanged tapering wall integrally extended from the middle-threaded portion.

28. The firearm muzzle attachment mechanism of claim 20, wherein the muzzle device comprises an internally threaded surface to threadedly engage with a gun barrel end of a firearm.

29. The firearm muzzle attachment mechanism of claim 20, wherein the hollow adapter comprises a plurality of teeth arranged adjacent to the internally threaded portion.

30. The firearm muzzle attachment mechanism of claim 20, wherein the muzzle attachment comprises a cylindrical tube portion integrally and outwardly thickened from a flanged taper wall of the muzzle attachment, wherein the receiving slot is formed between the cylindrical tube portion and the flanged taper wall.

31. The firearm muzzle attachment mechanism of claim 20, wherein the muzzle attachment comprises a middle portion defined between a cylindrical tube portion and a middle-threaded portion, and the receiving slot is formed on the middle portion.

32. The firearm muzzle attachment mechanism of claim 20, wherein the means for providing tension comprises a wire spring having a ring portion encircling the muzzle attachment.

33. The firearm muzzle attachment mechanism of claim 20, wherein the means for providing tension comprises a leg transversely extended from a ring portion, wherein the leg is received within the receiving slot of the muzzle attachment.

34. The firearm muzzle attachment mechanism of claim 20, wherein the receiving slot is transversally formed on a middle portion of the muzzle attachment.

35. The firearm muzzle attachment mechanism of claim 20, wherein the muzzle attachment further comprises a flanged taper wall having a reduced diameter which is smaller than a diameter of a cylindrical tube portion of the muzzle attachment.

36. The firearm muzzle attachment mechanism of claim 20, wherein the muzzle attachment further comprises an opening defining an opening edge, wherein the inner tapering end is formed along the opening edge.

37. The firearm muzzle attachment mechanism of claim 20, wherein a leg of the means for providing tension is received inside a groove formed on a plurality of teeth located inside the hollow adapter.

38. The firearm muzzle attachment mechanism of claim 21, wherein the outer tapering end comprises a threaded end sufficient to be received within the muzzle attachment.

39. The firearm muzzle attachment mechanism of claim 31, wherein the middle portion is outwardly thickened from a middle-threaded portion of the muzzle attachment and is sufficient to be received inside the hollow adapter.

* * * * *